US011324986B2

(12) United States Patent
Kehlenbach et al.

(10) Patent No.: US 11,324,986 B2
(45) Date of Patent: May 10, 2022

(54) WEIGHTLIFTING COLLAR SYSTEM AND METHOD

(71) Applicant: KTATX Ventures, LLC, Round Rock, TX (US)

(72) Inventors: Kathrin L. Kehlenbach, Round Rock, TX (US); Tyrell L. Higgins, Austin, TX (US); Anna D Cardinal, Round Rock, TX (US)

(73) Assignee: KTATX VENTURES, LLC

( * ) Notice: Subject to any disclaimer, the term of this patent is extended or adjusted under 35 U.S.C. 154(b) by 0 days.

(21) Appl. No.: 16/553,904

(22) Filed: Aug. 28, 2019

(65) Prior Publication Data

US 2021/0060376 A1 Mar. 4, 2021

(51) Int. Cl.

| | |
|---|---|
| ***A63B 21/072*** | (2006.01) |
| ***A63B 21/00*** | (2006.01) |
| ***A63B 21/08*** | (2006.01) |
| ***A63B 21/075*** | (2006.01) |

(52) U.S. Cl.

CPC ..... *A63B 21/0728* (2013.01); *A63B 21/0004* (2013.01); *A63B 21/075* (2013.01); *A63B 21/0724* (2013.01); *A63B 21/08* (2013.01); *A63B 2225/09* (2013.01)

(58) Field of Classification Search

CPC ..... A63B 21/0728; A63B 21/0724; A63B 21/072; A63B 21/06; A63B 21/08; B29C 39/26; F16B 2/06; F16B 2/185; F16B 2/10; A01D 34/902; B25F 5/026; A44C 9/0046; A44C 5/12; E05D 15/0634; E05D 15/0652; E05D 15/0647; E05D 15/0686

See application file for complete search history.

(56) References Cited

U.S. PATENT DOCUMENTS 4,639,979 A * 2/1987 Polson ..... A63B 21/0728 24/273
4,971,318 A * 11/1990 Tracy ..... A63B 21/0728 482/107
5,062,631 A * 11/1991 Dau ..... A63B 21/0728 482/107

(Continued)

OTHER PUBLICATIONS

Lexico.com Oxford English Dictionary 2020 edition; Nov. 30, 2020.*

(Continued)

*Primary Examiner* — Andrew S Lo
*Assistant Examiner* — Andrew M Kobylarz
(74) *Attorney, Agent, or Firm* — The Law Firm of H. Dale Langley, Jr., PC

(57) ABSTRACT

A system for clamping a bar, as non-exclusive example, a barbell collar, includes a first jaw forming a first portion of a hollow cylinder, a second jaw forming a second portion of the hollow cylinder, a hinge connecting the first jaw and the second jaw, a guide of the first jaw, a first latch element connected to the first jaw opposite the hinge, and a second latch element capable of removably connecting to the first latch element, the second latch element connected to the second jaw opposite the hinge. The first jaw and the second jaw form the hollow cylinder when the first latch element is connected to the second latch element. The system provides may include a weight that is attachable to the second jaw.

8 Claims, 3 Drawing Sheets

(56) References Cited

U.S. PATENT DOCUMENTS

| | | | | |
|---|---|---|---|---|
| 6,599,201 | B1 * | 7/2003 | Grant | A63B 69/3638 473/226 |
| 6,612,936 | B1 * | 9/2003 | Matias | A63B 69/3638 473/256 |
| 7,727,080 | B1 * | 6/2010 | Fitzgerald | A63B 69/3632 473/221 |
| 2006/0217244 | A1 * | 9/2006 | Hudson | A63B 21/0728 482/93 |
| 2020/0094100 | A1 * | 3/2020 | Garcia Castillo | A63B 21/072 |

OTHER PUBLICATIONS https://www.merriam-webster.com/dictionary/form; Date Updated; Sep. 21, 2021.*

* cited by examiner

WEIGHTLIFTING COLLAR SYSTEM AND METHOD

TECHNICAL FIELD

The invention generally relates to weightlifting devices, and more particularly relates to a collar for retaining weights and adding weights to a weightlifting bar.

BACKGROUND

As weightlifters are aware, time and effort during weightlifting exercise can be undesirably expended on replacing and fixing free weight disks on a bar. Conventional weight securement collars are typically ring or tubular design, must be fed onto and slid off the bar to change weights, and often require screw set, spring grip, or other similar securement devices for retaining the collar relatively fixed to the bar. Those collars are cumbersome in use in fixing to the bar and must be removed from the bar for change of weight disks.

Further, those collars must typically be removed from the bar in order to increase or decrease weights, for example, by removing weight disks of the like, from the bar. Therefore, there has been a repetitive cycle of fixing the collar to retain weights, weightlifting, then removing the collar, adding weights, again fixing the collar, and so forth. The addition and removal of weights requires time and effort, and streamline of the process would be welcome.

It would, therefore, be a significant improvement in the art and technology to provide a more easily removable and engageable clamp to a bar. It would further be a significant improvement to provide less cumbersome operations of adding and removing weight from the bar.

SUMMARY

An embodiment of the invention includes a system for, as non-exclusive example, clamping a bar. The system includes a first jaw forming a first portion of a hollow cylinder, a second jaw forming a second portion of the hollow cylinder, a hinge connecting the first jaw and the second jaw, a guide of the first jaw, a first latch element connected to the first jaw opposite the hinge, and a second latch element capable of removably connecting to the first latch element, the second latch element connected to the second jaw opposite the hinge. The first jaw and the second jaw form the hollow cylinder when the first latch element is connected to the second latch element.

Another embodiment of the invention is a system. The system includes a clamp for a bar and a weight removably attachable to the clamp.

Yet another embodiment of the invention is a method of manufacture. The method of manufacture includes forming a first jaw configured to form a portion of a throughway for a bar, forming a second jaw configured to form another portion of the throughway for the bar, hinging the first jaw to the second jaw, and providing a latch to the first jaw and the second jaw. The latch connects the first jaw to the second jaw opposite the hinge to complete the throughway.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
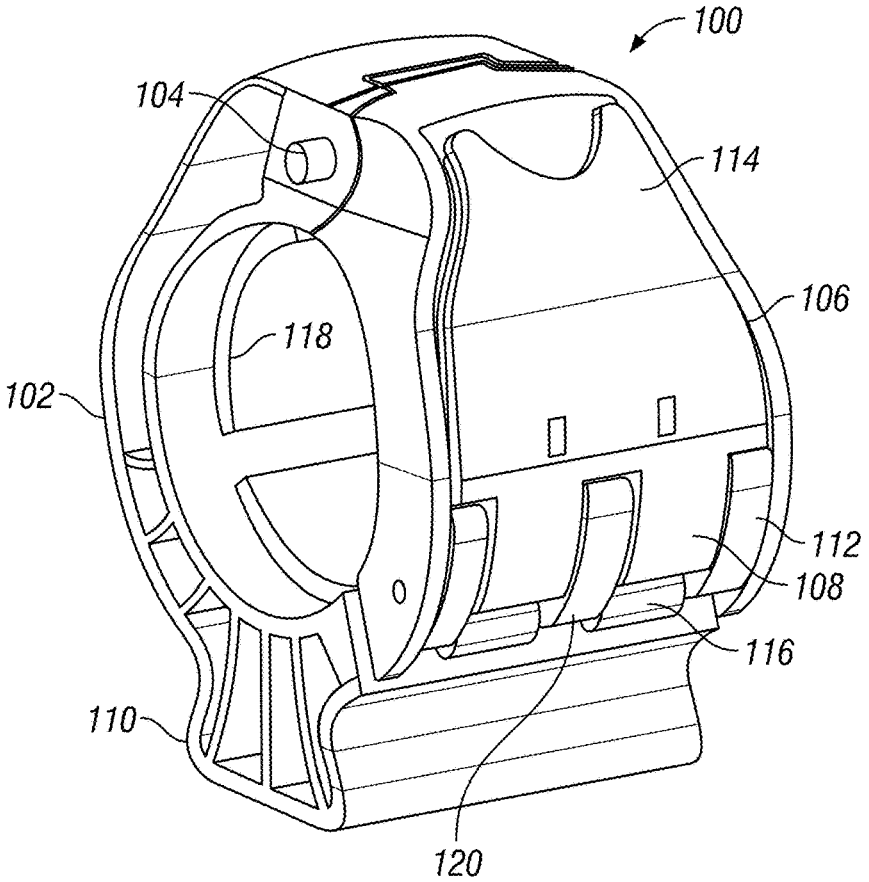
FIG. 1 illustrates a front and left side perspective view of a system, with a latch engaged, for clamping a bar, according to certain embodiments of the invention.

Referring to FIG. 1, a system 100 operates as a collar for retaining weight plates on a bar. The system 100 includes a left jaw 102 connected by a hinge 104 to a right jaw 106. A latch 108 provides a levered coupling between the left jaw 102 and the right jaw 106, forming a clamp for the bar when the latch 108 is closed.

The latch 108 includes in the right jaw 106 a catch 112 and a release lever 114. The lever 114 selectively engages the catch 112 of the right jaw 106 to a shelf 116 of the left jaw 104. The release lever 114 is operable to release the catch 112 from the shelf 116. When released, the right jaw 106 may rotate from the left jaw 104 on the hinge 104 opening the clamp. A spring 120 may be connected to the lever 114 and the catch 112 to urge the lever 114 towards the right jaw 106 and allow the catch 112 to snap onto the shelf 116 when the right jaw 106 is urged toward the left jaw 102 on the hinge 104.

A bottom portion of the left jaw 102 adjacent the shelf 116 includes a guide rail 110. The guide rail 110 is sized and configured to, if and as desired, retain an added weight that has a corresponding indentation to fit the guide rail 110.

A washer 118 may extend internally on the left jaw 102 and right jaw 106 to assist in clamping of the system 100 and gripping of a bar clamped in the system 100. The washer 118 may be segmented or continuous as desired in the embodiments.

In operation, the right jaw 106 and the left jaw 102 connected by the hinge 104 form a bore hole through which a bar or shaft, such as a barbell bar, may be lodged. The bar or shaft may be fed longitudinally into the bore hole. Alternatively, the right jaw 106 may be rotated on the hinge 104 away from the left jaw 102 sufficient to clamp the bar along its cross-section into the separated space between the right jaw 106 and left jaw 102.

In the system 100, the catch 112 of the right jaw 106 may be engaged with the shelf 116 of the left jaw 102 to form a clamp. The catch 112 automatically engages the shelf 116 when the right jaw 106 is rotated towards and to the left jaw 102 on the hinge 104. The lever 114, when pressed towards the right jaw 106 after the catch 112 engages the shelf 116, locks the system 100 in position on a bar. The right jaw 106 is released from engagement with the left jaw 102 by lift of the release lever 114 away from the right jaw 106 and consequent shift of the catch 112. The catch 112 may include a rod 202 (shown in FIGS. 2 and 3) for engagement under the shelf 116 when the catch 112 is engaged.

Figure 2:
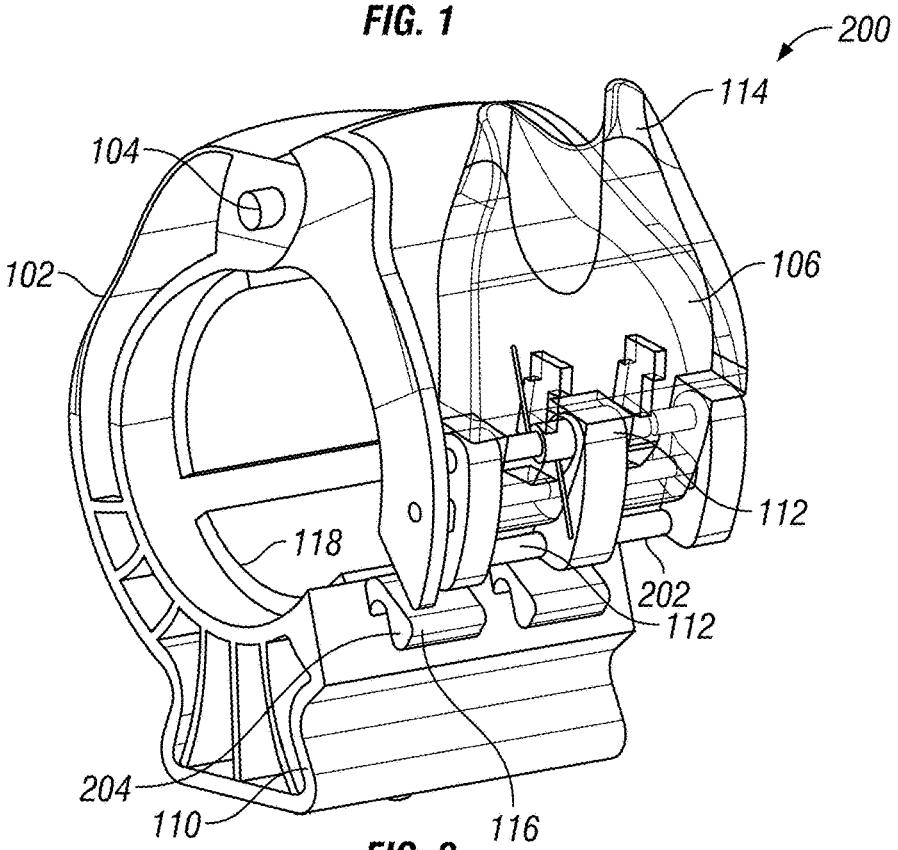
FIG. 2 illustrates a front and left side perspective view of a system, with a latch disengaged, for clamping a bar, according to certain embodiments of the invention.

Referring to FIG. 2, in conjunction with FIG. 1, a system 200 includes the left jaw 102 and the right jaw 106 joined by the hinge 104. The latch lever 114 (shown in phantom), positioned outward/downward with respect to the position in FIG. 1, causes the catch 112 to overcome a ridge 204 of the shelf 116. This disengages the right jaw 106 from the left jaw 102 when rotated (outward/upward in the Figure) on the hinge 104 away from the left jaw 102. As disengaged, the catch 112 of the latch 108 is shown moved away from the shelf 116 of the left jaw 102.

In operation, clamping of the right jaw 106 to the left jaw 102 is released and the right jaw 106 pivots on the hinge 104 with respect to the left jaw 102, when the lever 114 is lifted (i.e., forced forward and downward in FIG. 2). This lift of the lever 114 releases the catch 112 from under the ridge 204 and from the shelf 116.

Figure 3:
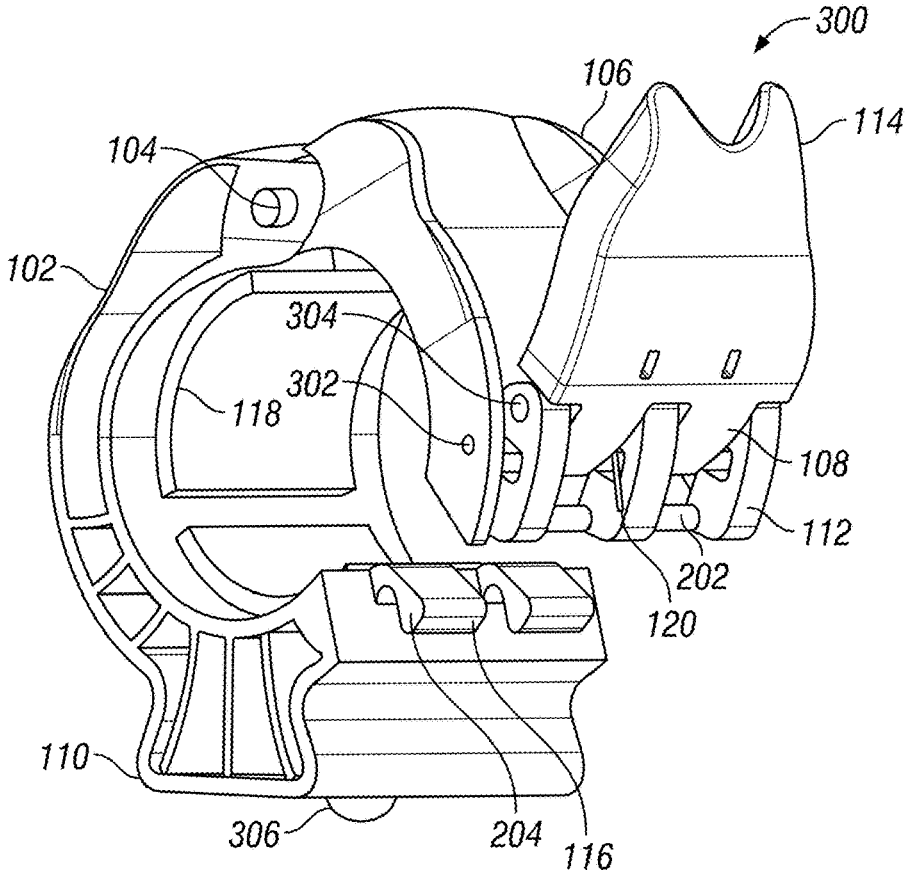
FIG. 3 illustrates a front and left side perspective view of a system, with a lifted latch that is disengaged, for clamping a bar, according to certain embodiments of the invention.

Referring to FIG. 3, a system 300 includes the left jaw 102 and the right jaw 106 joined by the hinge 104. The right jaw 106 connects to the latch 108 and release lever 114. The latch 108 connects to the catch 112. When the release lever 114 is lifted (outward and downward in FIG. 3), the latch 108 causes the catch 112 to rotatingly withdraw (outward and upward in FIG. 3) from engagement with the shelf 116. The spring 120 tends the latch 108 and release lever 114 towards the right jaw 106 and the catch 112 towards the shelf 116 of the left jaw 102. When the release lever 114 is pressed outward from the right jaw 106, the latch 108 causes the catch 112 to outwardly move away from the left jaw 102 and overcoming force of the spring 120. The catch 112 raises from the shelf 116 releasing the right jaw 106 from clamped connection with the left jaw 102.

The catch 112 is connected to extent of the right jaw 106 by a first rod 302. The catch 112 is capable of rotating on the first rod 302. The latch 108 is also connected to the first rod 302 at extent of the release lever 114, and is capable of rotating on the first rod 302. The latch 108 is also connected to a second rod 304 a measure away from the first rod 302 and towards other extent of the release lever 114. The latch 108 is capable of rotating on the second rod 304. The catch 112 is connected to the second rod 304 towards an extent of the catch 112 opposing the rod 202 connected to the catch 112. The catch 112 is also centrally rotatingly connected to the first rod 302. The latch 108 acts as a lever to lift an opposing lever of the catch 112.

At bottom and generally centered in the guide rail 110 is a nub 306. The nub 306 is, for non-exclusive example, a depressible ball bearing or portion of ball bearing, disposed in the bottom of the guide rail 110. The nub 306 serves to retain and for removal of a weight (shown in FIG. 6).

In operation, the system 300 opens clamping when the right jaw 106 swings from the left jaw 102 on the hinge 104. For opening, the catch 112 must be released from the shelf 116. This release occurs when the release lever 114 is lifted, causing the catch 112 to lift in opposing manner to displace the rod 202 away from the shelf 116. Because of the spring 120, the lever 114 and the rod 202 of the catch 112 are biased towards the first jaw 106 and the second jaw 102. If and when the spring 120 bias is overcome by lift of the lever 114, and consequent lift of the rod 202 of the catch 112, the rod 202 of the catch 112 is lifted. Bias of the spring 120 allows the clamping of the rod 202 to the shelf 116 to automatically occur with a click, when the right jaw 106 is rotatingly pressed on the hinge 104 to the left jaw 102.

Figure 4:
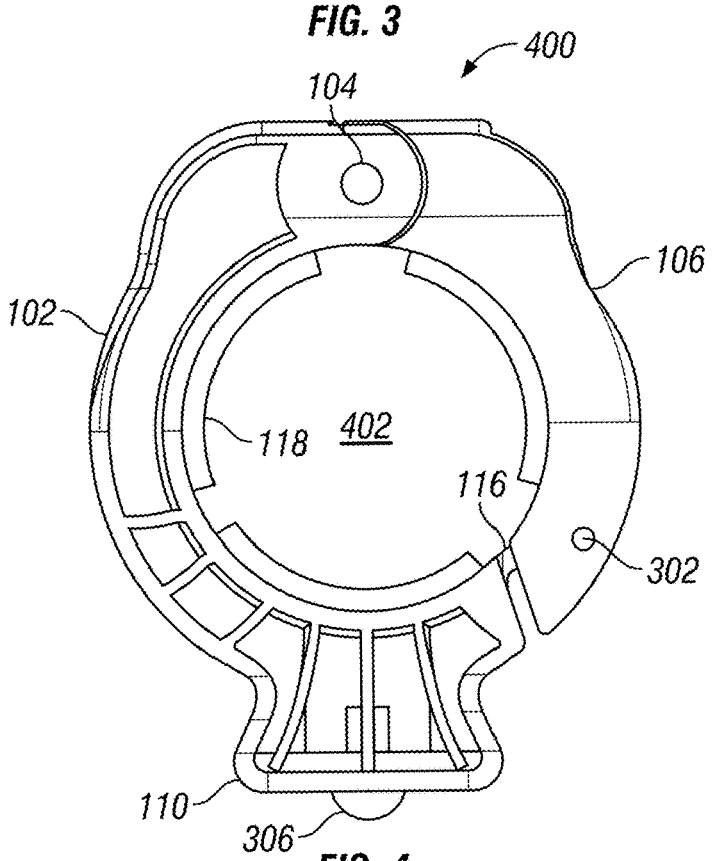
FIG. 4 illustrates a left side view of a system, with a latch engaged, for clamping a bar, according to certain embodiments of the invention.

Referring to FIG. 4, a system 400 includes the left jaw 102 and the right jaw 106 connected to the left jaw 102 at one extent by the hinge 104 and at the other extent by the catch 112 engaged to the shelf 116. That clamp formed of the left jaw 102 and the right jaw 106 is in closed position, in which the system 400 retain a bar, such as a bar of a barbell, in the clamp.

In operation, the clamp of the system 400 is closed around a bar (not shown) retained within a hole 402 formed of the left jaw 102 and the right jaw 106. In such closed position, the washer 118 abuts and grips the bar. The system 400 clamps the bar, such as, for non-exclusive example, to retain weights on the bar.

Figure 5:
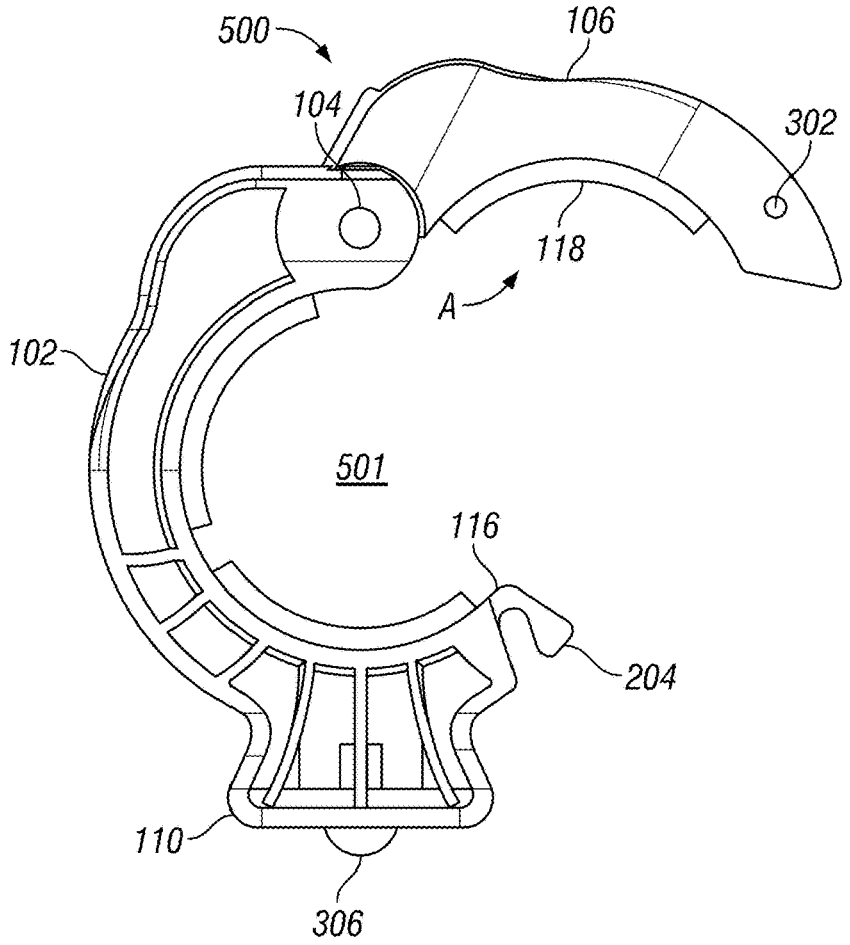
FIG. 5 illustrates a left side view of a system, with a latch disengaged and jaws separated, for clamping a bar, according to certain embodiments of the invention.

Referring to FIG. 5, a system 500 includes the left jaw 102 connected to the right jaw 106 by the hinge 104. The system 500 is positioned with the right jaw 106 rotated on the pin outward and upward (in the direction of arrow A) from the left jaw 102. The catch 112 is disengaged and displaced from the shelf 116. A gap 501 formed between the left jaw 102 and the right jaw 106 may accept a bar or cylinder, such as, for non-exclusive example, a barbell.

In operation, the bar may be inserted longitudinally through (i.e., into in the Figure) the gap 501, or else the bar may be inserted cross-sectionally in the gap 501. For use as a clamp, the right jaw 106 is rotated opposite to arrow A, and pressed to cause the catch 112 to engage the shelf 116. The catch 112 engaged to the shelf 116 locks the rod 202 (not shown) behind the ridge 116 to retain and clamp in place.

Figure 6:
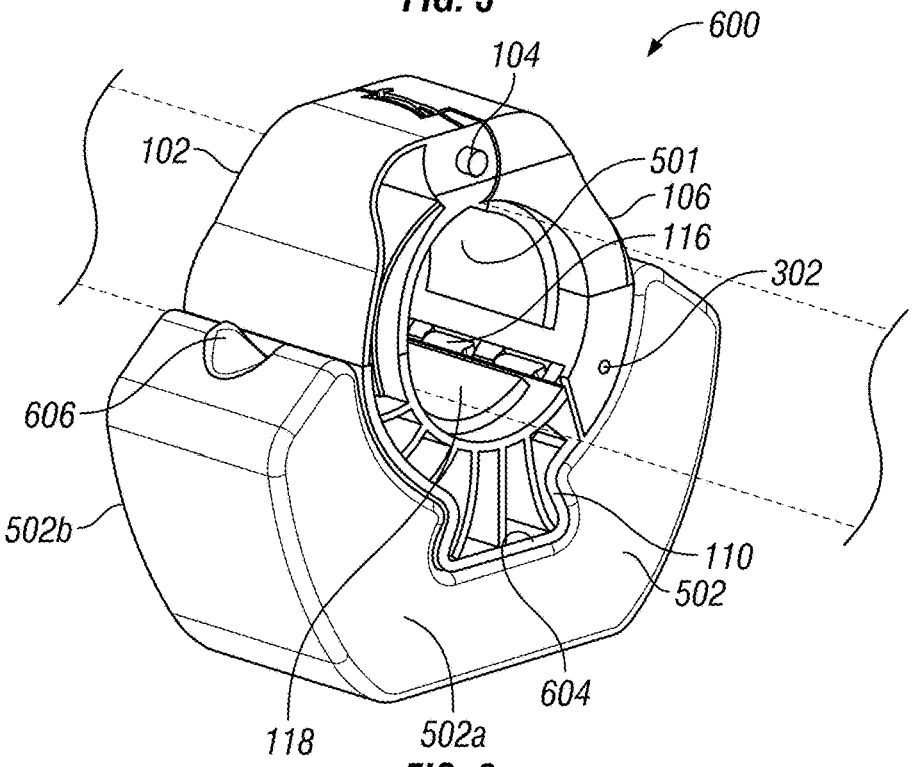
FIG. 6 illustrates a back and left side view of a system, with a latch engaged joining jaws around a bar (in phantom), for clamping the bar, and including an added weight, according to certain embodiments of the invention.

Referring to FIG. 6, a system 600 includes the left jaw 102 connected to the right jaw 106 by the hinge 104 and clamped on a bar (shown in phantom). The system 600 further includes a non-exclusive embodiment of a weight 502 removably fitted to the guide rail 110 of the left jaw 102. The weight 502 may be formed about same width as that of the jaws 102,106 or otherwise, such that the guide rail 110 fits contiguous within a trough 504 of the weight 502. Faces 502*a*, 502*b* of the weight 502, when connected to the left jaw 102, may be substantially perpendicular to the bar, e.g., substantially parallel with sides of the jaws 102, 106. The weight 502 may have a generally flattened bottom and arcuate sides extending about halfway up sides of the clamp formed by the left and right jaws 102, 106. The weight 502 may include one or more indentation 506 on extended ends of the weight, for example, to aid in connecting and removing the weight 502 on the guide rail 110. The weight 502 may include, within the trough 504 (or otherwise) a notch or similar facial depression in order to accommodate the nub 306 of the left jaw 102. This may limit shifting of the weight 502 along the trough 504, until such shift is desired and force is applied to overcome the nib 306 in the depression.

In operation, a wide variety of the weight 502 are possible in the embodiments. The clamping system of the left and right jaws 102, 106 allow additional weight to be added to a clamped bar, without removal of the collar function of the system. For example, the weight may be interchanged with varying heaviness and structural configuration. The weight may be added or removed from engagement to the clamping system as desired. At any time, weight may be added or taken away. This may reduce time and effort required in weight lifting/training and in other use of the clamping system where weight may be added or removed, as desired.

As will be understood, wide variation is possible in the foregoing embodiments. A wide variety of configurations and alternatives are possible in the clamping system and weights. Certain non-exclusive embodiments include unitized features of the system, as well as component options. For non-exclusive example, the collar may be formed with weight or weight may be addable and removable, as desired. Materials used for the collar may be varied, including plastic, metal, polymer, rubber, and others, and materials for the weights may similarly varied, including metal, plastic, steel, concrete, and others. In certain non-exclusive alternatives, the latch of the collar is located in different location with respect to an attachment, such as guide rail, for adding and removing weights. For non-exclusive example, rather than located at lower (in the Figures) portion of the collar near the attachment for weight, the latch may be located at top or side of the collar and the hinge located opposite the latch in such location. Other non-exclusive alternatives include different lock or latch mechanism for the collar, including, but not limited to, different latch and shelf structure or configuration, magnetic latching, mechanical latching, and others. Although the collar unit and the weight unit are each illustrated as standalone and stationary, the combination of collar and weight can be integrated and/or each can include one or more part or component. Variation is also possible in the use and operations of the collar unit and/or the weight unit. Although certain operations, materials, and configurations are disclosed, numerous other systems, devices, elements, steps, operations, processes, methods and materials may be implemented in the systems.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system, comprising:

a first jaw forming a first portion of a hollow cylinder;

a second jaw forming a second portion of the hollow cylinder;

a hinge connecting the first jaw and the second jaw;

a guide rail of the first jaw, configured for removable connection of a weight direct to the guide rail;

a ridge connected to the first jaw opposite the hinge;

a latch lever capable of removably connecting to the ridge, the latch lever connected to the second jaw opposite the hinge;

wherein the first jaw and the second jaw form the hollow cylinder when the latch lever is connected to the ridge;

a first lever connected to the second jaw opposite the hinge; and a second lever operatively opposing the first lever, connected to the second jaw opposite the hinge;

wherein the first lever and the second lever form the latch lever.

2. The system of claim 1, further comprising:

the weight configured for removable connection direct to the guide rail.

3. The system of claim 2, further comprising:

the weight configured for removable connection direct to the guide rail.

4. The system of claim 1, further comprising:

a hook connected to the second jaw opposite the hinge;

wherein the hook forms the ridge.

5. A system, comprising:

a clamp for a bar, the clamp includes a guide rail along an outward edge of the clamp; and a weight removably attachable to the guide rail the weight removably connected to the guide rail of the second side; the clamp comprises a first side and a second side hinged to meet forming a throughway for the bar; and a latch for removably coupling the first side to the second side around the bar when the first side rotates on the hinge to meet the second side;

wherein the latch includes a first lever and second lever operatively opposing the first lever on lift of the first lever, the first lever and the second lever rotatingly connected to the first side.

6. The system of claim 5, wherein the latch includes a shelf connected to the second side, the second lever engages the shelf to retain the bar.

7. A method of manufacture, comprising:

forming a first jaw configured to form a portion of a throughway for a bar;

forming a second jaw configured to form another portion of the throughway for the bar, the second jaw includes a guide rail for removable connection of a weight;

hinging the first jaw to the second jaw;

providing a latch to the first jaw and the second jaw, the latch connects the first jaw to the second jaw opposite the hinge to complete the throughway; and providing a weight removably connected to the guide rail;

wherein providing the latch includes forming a first lever device connected to the first jaw;

wherein providing the latch includes forming a second lever device connected to the first jaw and operable by the first lever device.

8. The method of manufacture of claim 7, wherein providing the latch includes forming a shelf connected to the second jaw, the second lever device engageable to the shelf completes the throughway and locks the first jaw and the second jaw in engagement to a bar through the throughway.

* * * * *